US008042923B2

(12) United States Patent
Matsumoto

(10) Patent No.: US 8,042,923 B2
(45) Date of Patent: Oct. 25, 2011

(54) LIQUID EJECTING HEAD AND INK JET PRINTING APPARATUS

(75) Inventor: Mitsuhiro Matsumoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 646 days.

(21) Appl. No.: 12/198,584

(22) Filed: Aug. 26, 2008

(65) Prior Publication Data

US 2009/0058934 A1 Mar. 5, 2009

(30) Foreign Application Priority Data

Aug. 30, 2007 (JP) ..... 2007-224022

(51) Int. Cl.
*B41J 2/175* (2006.01)

(52) U.S. Cl. ..... 347/85; 347/65

(58) Field of Classification Search ..... 347/9, 12, 347/40, 42, 43, 47, 65–71
See application file for complete search history.

(56) References Cited

U.S. PATENT DOCUMENTS

| | | | | |
|---|---|---|---|---|
| 6,652,079 | B2 | 11/2003 | Tsuchii et al. | |
| 6,779,871 | B1 * | 8/2004 | Seto et al. | 347/40 |
| 6,971,736 | B2 | 12/2005 | Tomizawa et al. | |
| 6,984,026 | B2 | 1/2006 | Tomizawa et al. | |
| 2008/0055368 | A1 | 3/2008 | Oikawa et al. | |
| 2008/0239011 | A1 | 10/2008 | Ide et al. | |
| 2009/0058933 | A1 | 3/2009 | Matsumoto et al. | |
| 2009/0066752 | A1 | 3/2009 | Ide et al. | |
| 2009/0066753 | A1 | 3/2009 | Matsumoto | |

FOREIGN PATENT DOCUMENTS

| | | |
|---|---|---|
| JP | 2002-248769 | 9/2002 |
| JP | 2002-321369 | 11/2002 |
| JP | 2004-42651 | 2/2004 |
| JP | 2004-42652 | 2/2004 |

* cited by examiner

*Primary Examiner* — Thinh Nguyen
(74) *Attorney, Agent, or Firm* — Fitzpatrick, Cella, Harper & Scinto

(57) ABSTRACT

When each of an energy acting chamber and a second ejection port portion is partitioned by a first virtual plane into an area positioned on a first side of the first virtual plane and an area positioned on a second side of the first virtual plane, the energy acting chamber has a larger volume in the first side area than in the second side area. Conversely, the second ejection port portion has a smaller volume in the first side area than in the second side area. The first virtual plane is parallel to both a supply direction of a liquid flowing to the energy acting chamber and an ejection direction, and passes through a center of a heating element. The first virtual plane divides each of the energy acting chamber and the second ejection port portion into two parts in an orthogonal direction orthogonal to the supply direction.

8 Claims, 13 Drawing Sheets

LIQUID EJECTING HEAD AND INK JET PRINTING APPARATUS

BACKGROUND OF THE INVENTION

1. Field of the Invention

The present invention relates to a liquid ejecting head that accurately ejects ink droplets, and an ink jet printing apparatus.

2. Description of the Related Art

In recent years, serial scan type ink jet printing apparatuses (liquid ejecting apparatuses) have been increasing rapidly, in which a print head, as a liquid ejecting head, ejects ink droplets (liquid droplets) during movement with respect to a print medium to print on the print medium. These ink jet printing apparatuses have the advantages of being easily miniaturized and capable of printing color images relatively easily. In addition to the serial scan type ink jet printing apparatus, which prints images by moving the print head, full line type ink jet printing apparatuses are available. This type of printing apparatus uses a long print head extending all along a print area of the print medium in a width direction to print images without the need to move the print head.

Attempts have been made to reduce the size of ejected ink droplets in order to improve the quality of printed images. Furthermore, the frequency in use of the ink jet printing apparatuses has recently been increasing. Thus, attempts have been made to improve durability performance.

One method for reducing the size of liquid droplets ejected from the liquid ejecting head (including the print head) is to reduce the size of ejection ports through which liquid droplets are ejected. However, the reduced size of each of the ejection ports increases the flow resistance to the liquid at the ejection port. This may prevent desired liquid ejection performance and ejection efficiency from being achieved. That is, the thickness of an orifice plate in which the ejection ports are formed increases relative to the reduced opening area of the ejection port. For example, Japanese Patent Laid-Open Nos. 2004-042652 and 2004-042651 propose a configuration for reducing the flow resistance to ink (liquid) at the ejection port while maintaining the strength of the print head.

In the proposed print heads, the ejection port is formed by a first ejection port portion located closer to an opening portion of the ejection port and a second ejection port portion communicating with the first ejection port portion. In these print heads, the flow resistance to the ink can be reduced by reducing the thickness only of the opening portion (first ejection port portion) of the ejection port in the orifice plate. Thus, a decrease in the strength of the orifice plate can be inhibited. Furthermore, when bubble energy resulting from bubble of the ink is utilized to eject the ink, bubbles generated in the ink are efficiently grown from the second ejection port portion toward the first ejection port portion. This improves ink ejection performance and efficiency.

Furthermore, various attempts have been made to improve the durability performance of the print head. The improved durability performance of the print head enables an increase in the number of possible droplet ejections during the working life of the print head.

According to an ink ejecting method utilizing an ink film boiling phenomenon, an electrothermal converting element generates heat to cause the ink to bubble so that the resulting bubble energy is utilized to eject the ink through the ejection port. When the electrothermal converting element generates heat, a thermochemical reaction occurs between the surface of a protective film covering the electrothermal converting element and the ink. As a result, the protective film may be oxidized or dissolved. Furthermore, a possible impact force caused by cavitation during a debubbling process may scrape or damage the protective film. The degraded function of the protective film may cause the ink to be in appropriately ejected or result in inappropriate printing. To deal with this, attempts have been made to improve the durability performance by improving the protective film and the shape of nozzles.

A nozzle shape for decreasing the possible impact force resulting from cavitation is described in Japanese Patent Laid-Open Nos. 2002-321369 and 2002-248769. In this nozzle shape, the center line of an ink channel is displaced from the center line of the electrothermal converting element. Thus, the position where bubbles generated by the electrothermal converting element are defoamed can be fluctuated and shifted. Furthermore, by changing the flow of the ink during the defoaming, the defoaming can be prevented from occurring over the electric heating element. Additionally, by displacing the center line of the electrothermal converting element from the center line of a bubbling chamber, the amount of displacement of the center of the ejection port from the center of the electrothermal converting element can be increased by the amount of displacement of the center of the ejection port from the center of the bubbling chamber and can be minimized. Thus, the ink is prevented from collecting in the vicinity of the ejection port, allowing the ink to be accurately ejected even with the defoaming position moved. Thus, controlling the ink flow in association with the defoaming allows bubbles to be biased toward the side of the electrothermal converting element. This enables a reduction in the possible impact force exerted on the electrothermal converting element by cavitation during the defoaming. The durability of the print head can thus be improved.

However, the reduced amount of ejected ink (liquid) relatively makes the effects of the nozzle structure on ink droplets (droplets) more significant. For example, if the center of the bubbling chamber (energy acting chamber) with the electrothermal converting element provided therein is displaced from the center of the ejection port to make the bubbling chamber asymmetric, the ejected ink droplets are more significantly affected. Specifically, when the bubble energy resulting from bubbling of the ink in the bubbling chamber is utilized to eject the ink and the bubbling chamber is then refilled with ink through an ink channel, a plane is assumed which divides the bubbling chamber into two parts. The plane is almost perpendicular to an element board on which the electrothermal converting element is formed and is almost parallel to the ink channel. The plane passes through the center of the electrothermal converting element. If the plane is used to divide the asymmetric bubbling chamber into two parts, one of the parts has a larger first area and the other has a smaller second area. If such an asymmetric bubbling chamber is refilled with ink through the ink channel, the ink flows from the first area to the second area.

A force in the direction of the flow acts on the ink refilled into the bubbling chamber. Thus, a trailing end (trailing portion) of the ink droplet resulting from ejection of the ink in the bubbling chamber is likely to bend in a direction from the first area toward the second area. As a result, the trailing portion of the ink droplet is torn away and separated into fine satellites. The satellites may impact the print medium at an inaccurate position (impacting accuracy) or become small floating mists.

The small mist, separated from the trailing portion of the ink droplet, may float between the print head and the print medium and adhere to the print head or the print medium. If the mist adheres to a peripheral part of the ejection port in the print head, the mist may hinder movement of the ejected ink and reduce the accuracy of the ink droplet impact.

The reduced impact accuracy of the ink droplets may cause ink dots to be formed at unexpected positions on the print medium. This may degrade the quality of a printed image. Furthermore, if the ink mist adheres to the print head and an unspecified part in the printing apparatus, the printing apparatus may malfunction. Additionally, the ink adhering to the printing apparatus may stain the print medium to degrade the print quality of the printed medium.

SUMMARY OF THE INVENTION

The present invention provides a liquid ejecting head which is more durable due to an energy acting chamber in which a liquid is bubbled and which has an asymmetric shape, the liquid ejecting head provides highly accurate ink ejection to be maintained while enabling a reduction in possible mist. The present invention also provides an ink jet printing apparatus using the above-described liquid ejecting head.

In a first aspect of the present invention, there is a liquid ejecting head comprising a nozzle having an energy acting chamber provided with a heating element generating heat energy utilized to eject a liquid, and a liquid supply port communicating with the nozzle, wherein an ejection port portion communicating with the energy acting chamber is formed to eject the liquid to which heat energy is applied by the heating element, the ejection port portion has a first ejection port portion communicating with atmosphere and a second ejection port portion formed between the energy acting chamber and the first ejection port portion, the second ejection port portion has a larger sectional area than the first ejection port portion in a direction orthogonal to an ejection direction in which the liquid is ejected, when each of the energy acting chamber and the second ejection port portion is partitioned by a first virtual plane into an area positioned on a first side of the first virtual plane and an area positioned on a second side of the first virtual plane, the energy acting chamber has a larger volume in the first side area than in the second side area, and the second ejection port portion has a smaller volume in the first side area than in the second side area, and the first virtual plane is parallel to both a supply direction of a liquid flowing from the liquid supply port to the energy acting chamber and the ejection direction, and passes through a center of the heating element to divide each of the energy acting chamber and the second ejection port portion into two parts in an orthogonal direction orthogonal to the supply direction.

In a second aspect of the present invention, there is provided an ink jet printing apparatus that prints an image on a print medium using a liquid ejecting head comprising a nozzle having an energy acting chamber in which a heating element generating heat energy utilized to eject a liquid is located, and a liquid supply port communicating with the nozzle, wherein an ejection port portion communicating with the energy acting chamber is formed to eject the liquid to which heat energy is applied by the heating element, the ejection port portion has a first ejection port portion communicating with atmosphere and a second ejection port portion formed between the energy acting chamber and the first ejection port portion, the second ejection port portion has a larger sectional area than the first ejection port portion in a direction orthogonal to an ejection direction in which the liquid is ejected, when each of the energy acting chamber and the second ejection port portion is partitioned by a first virtual plane into an area positioned on a first side of the first virtual plane and an area positioned on a second side of the first virtual plane, the energy acting chamber has a larger volume in the first side area than in the second side area, and the second ejection port portion has a smaller volume in the first side area than in the second side area, and the first virtual plane is parallel to both a supply direction of a liquid flowing from the liquid supply port to the energy acting chamber and the ejection direction, and passes through a center of the heating element to divide each of the energy acting chamber and the second ejection port portion into two parts in an orthogonal direction orthogonal to the supply direction.

According to the present invention, even when the position of the energy acting chamber in which the liquid is bubbled is displaced from the position of the heating element in order to make the liquid ejecting head more durable, the second ejecting portion displaced from the energy acting chamber in the opposite direction allows a trailing portion of the droplet to return to the center of the ejection port portion. That is, the trailing portion of the ejected droplet is not subjected to a force biased toward one direction but is ejected straight in the ejecting direction. Thus, the accuracy with which the droplet is ejected can be kept high. Furthermore, since the trailing portion of the ejected droplet is not subjected to the force biased toward one direction, possible mist can be reduced when the droplet is ejected.

Additionally, when the ink droplets as liquid droplets are ejected from the liquid ejecting head as a print head to print an image on the print medium, the impact accuracy of each ink droplet on the print medium can be improved to achieve a high quality print image. Moreover, possible ink mists can be reduced.

Further features of the present invention will become apparent from the following description of exemplary embodiments (with reference to the attached drawings).

DESCRIPTION OF THE EMBODIMENTS

First Embodiment

A first embodiment for carrying out the present invention will be described below with reference to the attached drawings.

Figure 1:
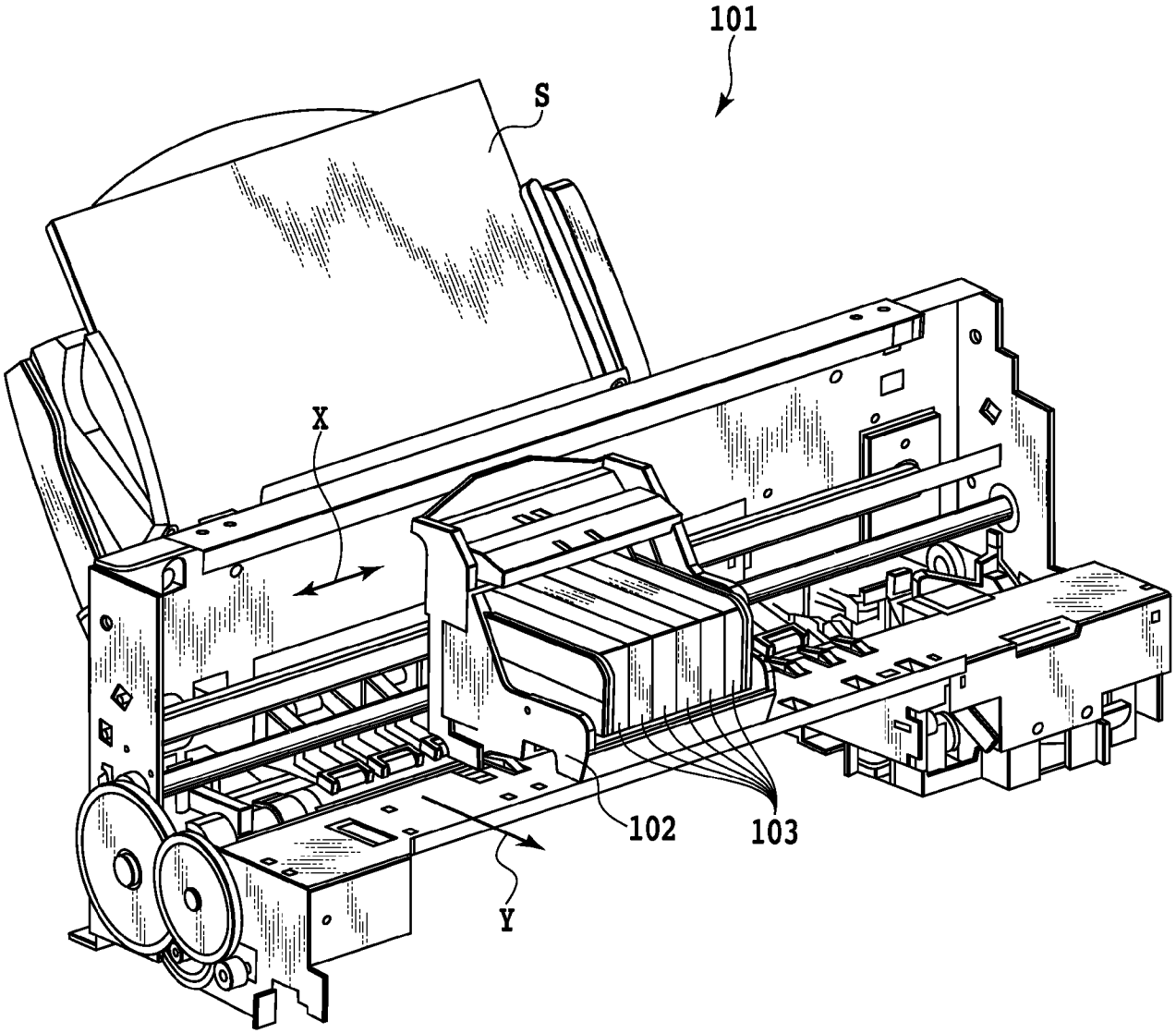
FIG. 1 is a perspective view of an ink jet printing apparatus using a liquid ejecting head according to a first embodiment of the present invention.

FIG. 1 is a perspective view of an ink jet printing apparatus 101 that uses a print head as a liquid ejecting head according to the first embodiment of the present invention. The ink jet printing apparatus 101 in the present example is of a serial scan type. Print heads and ink tanks corresponding to a plurality of ink colors are removably mounted on a carriage 102 that is moved in the direction of arrow X by a movement mechanism. In the present example, the print head and the ink tank constitutes an ink jet cartridge 103. A print medium S is conveyed, by a conveyor mechanism, in the direction of arrow Y crossing (in the present example, orthogonal to) the direction of arrow X through a print position located opposite the print head 1.

A print scan by the print head and an operation of conveying the print medium S in the direction of arrow Y are alternately repeated to print an image on the print medium S. The print scan is an operation in which the print head ejects ink fed from the ink tanks while moving in the direction of arrow X together with the carriage 102.

Figure 2B:
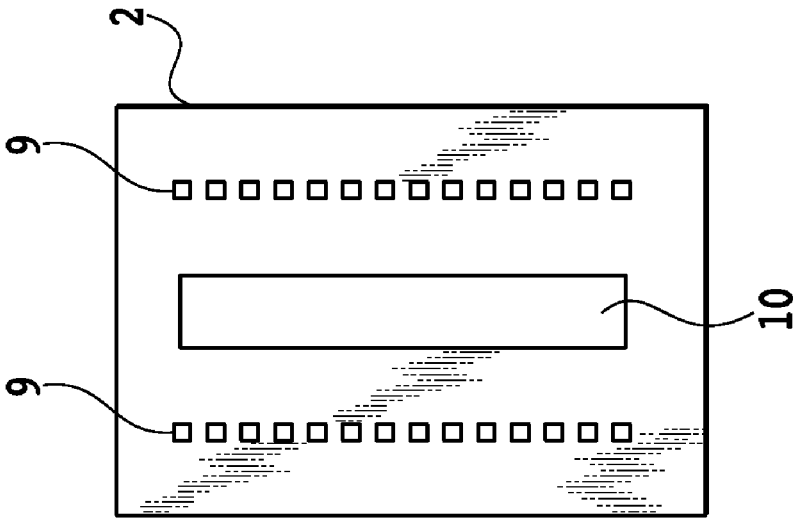
FIG. 2B is a plan view of an element board in the liquid ejecting head.
Figure 2A:
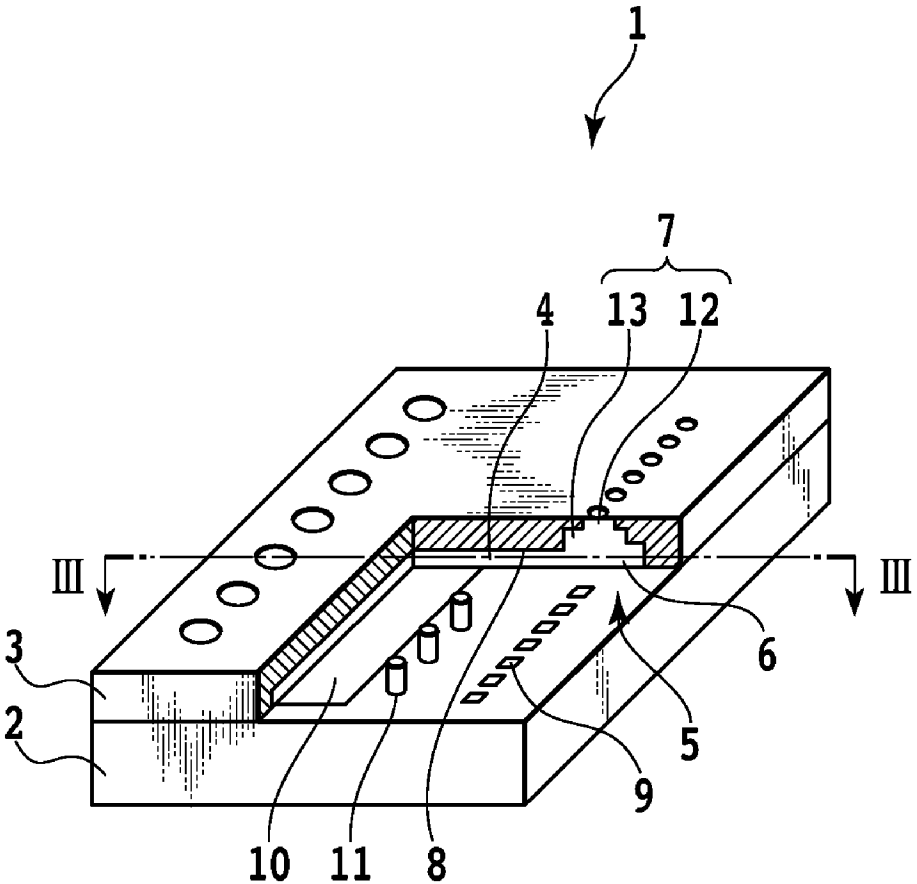
FIG. 2A is a partly cutaway perspective view of the liquid ejecting head according to the first embodiment of the present invention.

FIG. 2A is a partly cutaway perspective view of the print head 1 used in the printing apparatus in FIG. 1. FIG. 2B is a plan view of an element board 2, one of the components of the print head 1.

In the print head 1 in the present example, an orifice plate 3 is stuck to the element board 2. A common liquid chamber 4 is defined between the element board 2 and the orifice plate 3 to store ink as a liquid. An ink supply port (liquid supply port) 10 is formed in the element board 2 to supply the ink to the common liquid chamber 4. A plurality of nozzles 5 are formed on the opposite sides of the ink supply port 10 to eject the ink. Each of the nozzles 5 includes a bubble chamber (energy acting chamber) 6, an ejection port portion 7, an ink channel 8, and an electrothermal converting element 9. In the present example, the plurality of nozzles 5 are positioned along two parallel nozzle arrays. The pitch between the adjacent nozzles 5 in each nozzle array is equal to an interval corresponding to 600 dpi (see FIG. 3).

The ink channel (liquid channel) 8 is formed between the common chamber 4 and the bubbling chamber 6 to introduce the ink into the bubbling chamber 6. In the present embodiment, the bubbling chamber 6 is a part wider than the ink channel 8.

Figure 3:
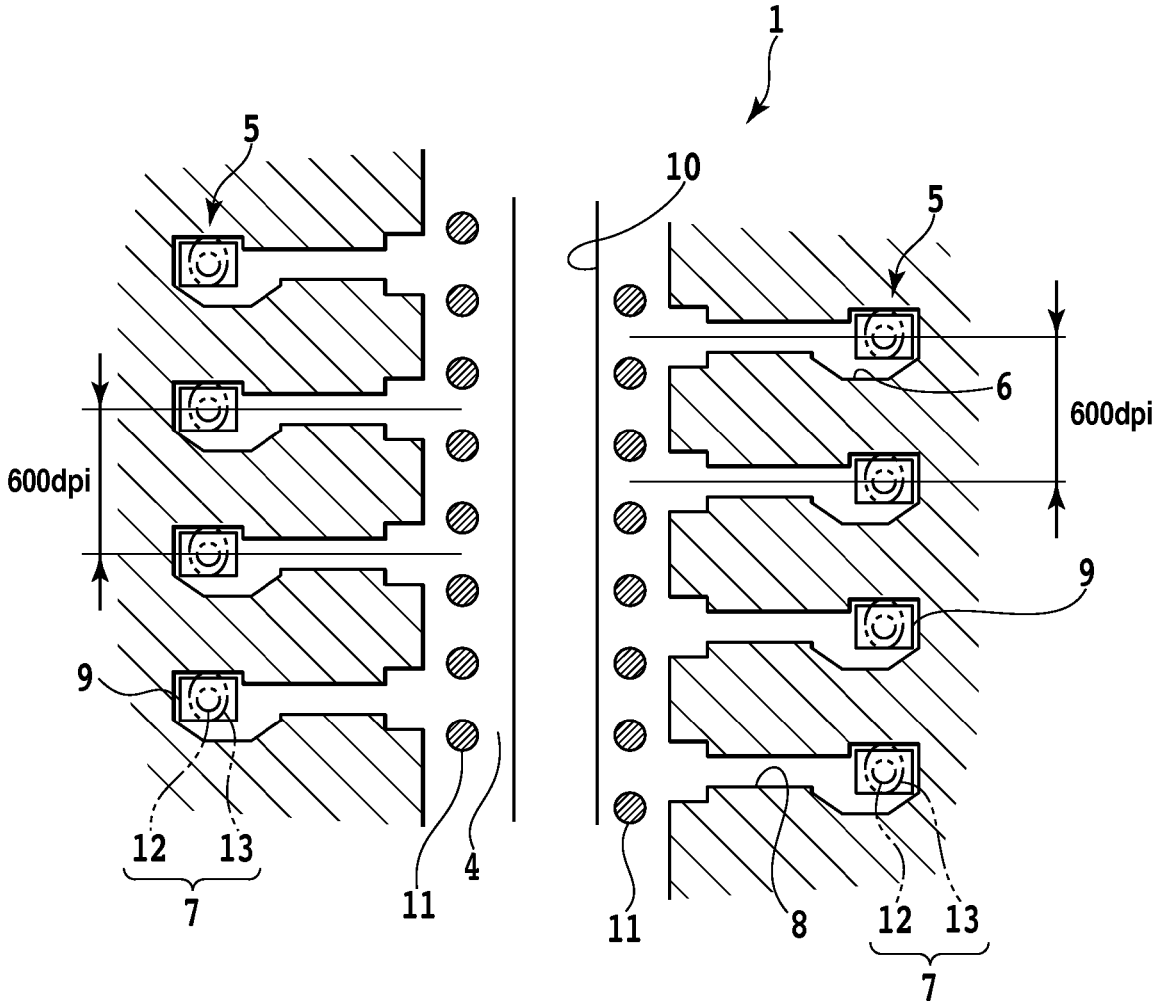
FIG. 3 is a sectional view of the liquid ejecting head in FIG. 2A taken along line III-III in FIG. 2A.

FIG. 3 is a sectional view of the print head 1 in FIG. 2A taken along line III-III in FIG. 2A.

A plurality of cylindrical nozzle filters 11 are arranged in the common liquid chamber 4 in the direction of the nozzle arrays. The nozzle filters 11 are arranged in the common liquid chamber 4 upstream of the ink channel 8 to prevent dirt and the like from flowing into the ink channel 8. The arrangement of the nozzle filters 11 between the element board 2 and the orifice plate 3 prevents the orifice plate from peeling off the element board 2, and supports loads from the orifice plate 3.

The ejection port portion 7 is formed in the orifice plate 3 so that the ink fed from the common liquid chamber 4 into the bubbling chamber 6 is ejected from ejection ports (opening portions at the tips of the nozzles 5) through the ejection port portion 7. The electrothermal converting element 9 is formed on the element board 2 as a heating element (heater) that generates heat energy utilized to eject the ink. The electrothermal converting element 9 is positioned inside the bubbling chamber 6 opposite the ejection port portion 7. The bubbling chamber 6, serving as an energy acting chamber, is a portion that applies kinetic energy required to eject the ink, to the ink. That is, the electrothermal converting element 9 is driven to generate heat to allow the ink fed into the bubbling chamber 6 to be bubbled. The resulting bubble energy can be utilized to eject the ink through the ejection port.

Figure 4:
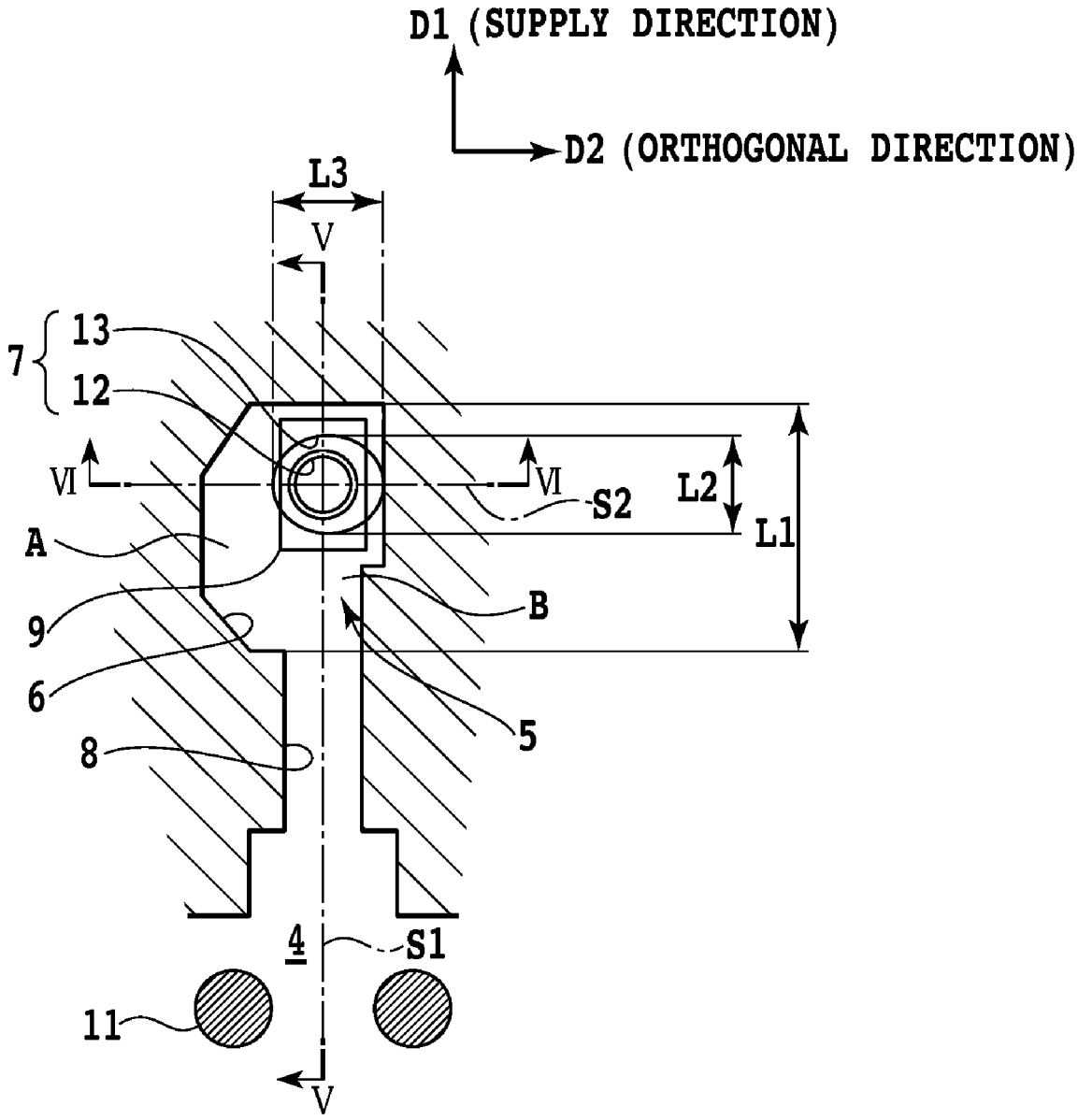
FIG. 4 is an enlarged sectional view of an essential part of the liquid ejecting head in FIG. 3.
Figure 5:
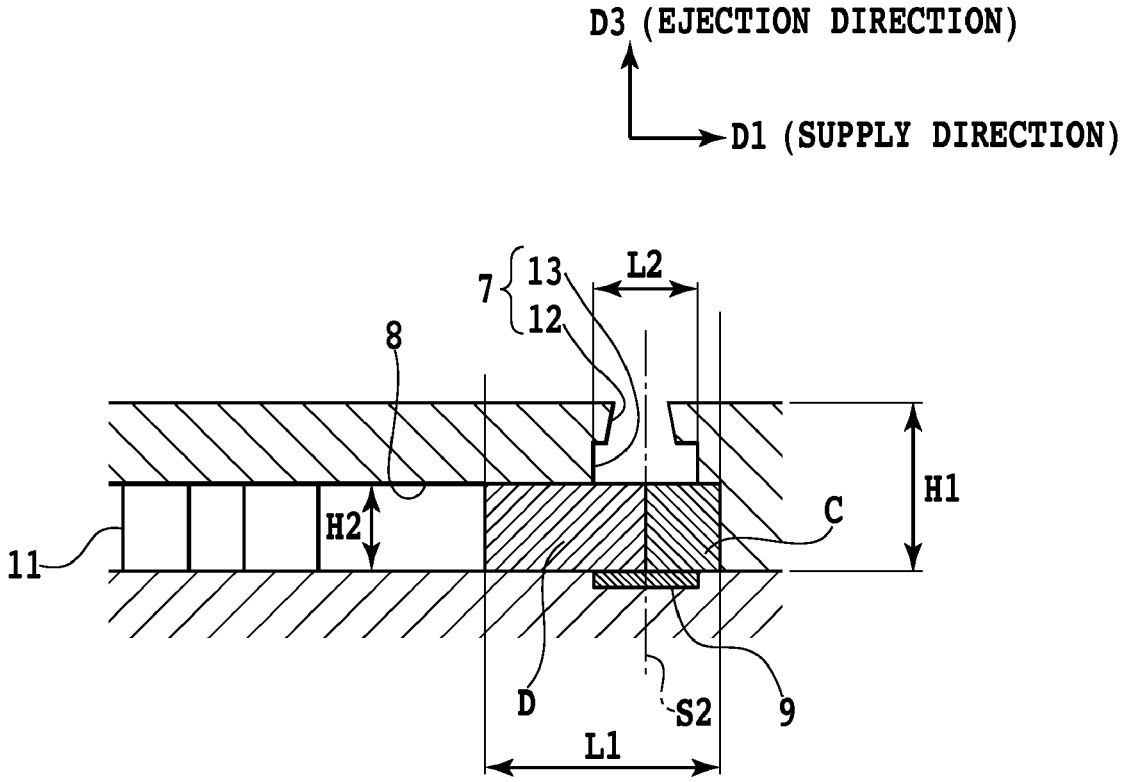
FIG. 5 is a sectional view of the liquid ejecting head in FIG. 4 taken along line V-V in FIG. 4.
Figure 6:
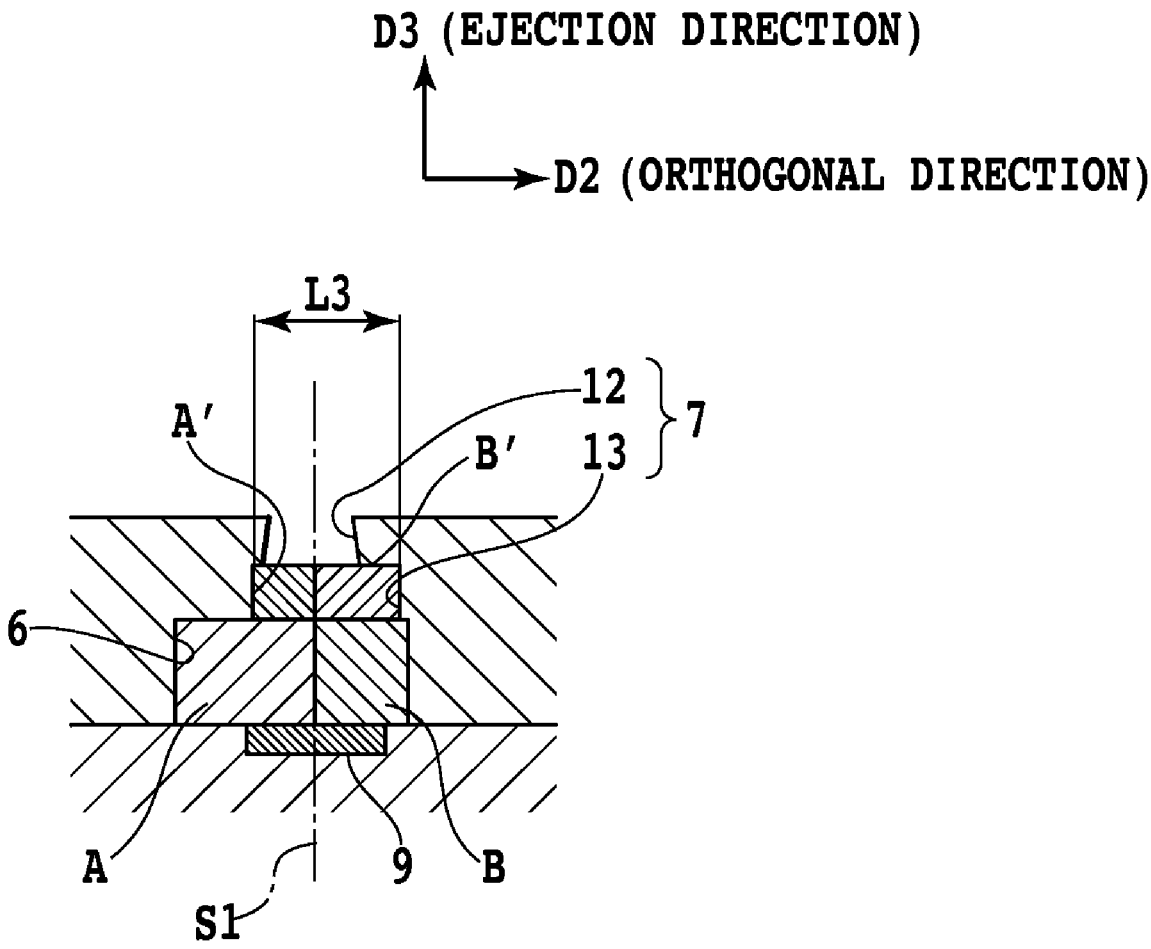
FIG. 6 is a sectional view of the liquid ejecting head in FIG. 4 taken along line VI-VI in FIG. 4.

FIG. 4 is an enlarged sectional view of one of the plurality of nozzles 5 shown in FIG. 3. FIG. 5 is a sectional view of the print head in FIG. 4 taken along line V-V in FIG. 4. FIG. 6 is a sectional view of the print head in FIG. 4 taken along line VI-VI in FIG. 4.

The ejection port portion 7 includes a first ejection port portion 12 and a second ejection port portion 13. The first ejection port portion 12 communicates with the atmosphere through the ejection port (the opening portion at the tips of the nozzle 5). The second ejection port portion 13 is formed between the bubbling chamber 6 and the first ejection port portion 12. The cross section of the second ejection port portion 13 along a plane orthogonal to an ink ejection direction is larger than that of the first ejection port portion 12 along the same plane. For convenience of description, in the ejection port portion 7, a direction in which the ink is fed from the common liquid chamber 4 toward the interior of the bubbling chamber 6 is defined as a supply direction D1. A direction crossing the supply direction D1 at right angles is defined as an orthogonal direction D2; the ejection ports are arranged and the ink supply port 10 extends, in the orthogonal direction D2.

The bubbling chamber 6 in the present example is a part wider than the ink channel 8. As shown in FIGS. 4 and 5, the bubbling chamber 6 corresponds to the part of a length L1 in the supply direction D1. The second ejection port portion 13 in the present example corresponds to a part having a length L2 in the supply direction D1 as shown in FIGS. 4 and 5 and a length L3 in the orthogonal direction D2 as shown in FIGS. 4 and 6.

Here, as shown in FIGS. 4 and 6, an orthogonal partitioning plane (first virtual plane) S1 is assumed which extends through the bubbling chamber 6 and the second ejection port portion 13. The partitioning plane S1 extends along the supply direction D1 to partition the interior of the nozzle 5 into two parts in the orthogonal direction D2; the partitioning plane S1 is a virtual plane used for convenience of description. The partitioning plane S1 in the present example is parallel to both the ink supply direction D1 from the ink supply port 10 toward the bubbling chamber 6 and an ejection direction D3 (see FIG. 6) in which the ink is ejected. That is, partitioning plane S1 is defined by a line along direction D1 and a line along direction D3. The partitioning plane S1 extends through the center of the electrothermal converting element 9.

In the internal space of the bubbling chamber 6, an area or region (the area in the left of FIG. 6) on one side of the partitioning plane S1 is defined as an area A and has a volume VA. An area or region (the area in the right of FIG. 6) on the other side of the partitioning plane S1 is defined as an area B and has a volume VB. In FIG. 6, the areas A and B are hatched. Furthermore, in the internal space of the second ejection port portion 13, an area or region (the area in the left of FIG. 6) on one side of the partitioning plane S1 is defined as an area A' and has a volume VA'. An area or region (the area in the right of FIG. 6) on the other side of the partitioning plane S1 is defined as an area B' and has a volume VB'. In FIG. 6, the areas A' and B' are hatched. In the present embodiment, as shown in FIG. 6, the volume VA of the area A is larger than the volume VB of the area B. The volume VA' of the area A' is smaller than the volume VB' of the area B'.

Thus, in the present embodiment, the partitioning plane S1 passing through the center of the electrothermal converting element 9 partitions the internal space of the bubbling chamber into the areas A and B, having the different volumes VA and VB. That is, the nozzle 5 is formed such that a relationship VA>VB is established between the volumes VA and VB. In particular, the volumes VA and VB desirably have a relationship VA/VB>1.3. The nozzle 5 is also formed such that a relationship VA'<VB' is established between the volumes VA' and VB'. In particular, the volumes VA' and VB' desirably have a relationship in which VA'/VB'>1.1.

Moreover, in the present embodiment, as shown in FIGS. 4 and 5, a supply direction partitioning plane (second virtual plane) S2 is assumed which extends through the bubbling chamber 6 and the second ejection port portion 13. The partitioning plane S2 is parallel to both the orthogonal direction D2 and the ejection direction D3 and extends through the center of the electrothermal converting element 9. The partitioning plane S2 divides the internal space of the nozzle 5 into two parts in the supply direction D1; the partitioning plane S2 is a virtual plane used for convenience of description.

In the internal space of the bubbling chamber 6, an area (the area in the right of FIG. 5) on one side of the partitioning plane S2 is defined as an area C and has a volume VC. An area (the area in the left of FIG. 5) on the other side of the partitioning plane S2 is defined as an area D and has a volume VD. In FIG. 5, the areas C and D are hatched. The volume VC is smaller than the volume VD. That is, the volume VD of the area D, positioned closer to the ink supply port 10, is set to be larger than the volume VC of the area C, positioned further from the ink supply port 10. Consequently, a relationship VC<VD is established between the volumes VC and VD.

The nozzle 5 according to the present embodiment is set to eject about 0.5 to 3 pl of ink and has an ink ejection frequency of at least 15 kHz. The inner diameter of the atmosphere side of the ejection port (the opening portion at the tip of the nozzle 5) in the first ejection port portion 12 is 4 to 15 μm, preferably 7 to 11 μm. In the present example, the ejection port diameter is about 5 to 12 μm. The inner diameter of the second ejection port portion 13 is about 15 to 25 μm. The channel width of the ink channel 8 is about 5 to 15 μm. The length of an ink channel corresponding to the height H1 from the electrothermal converting element 9 to a surface on which the ejection port is formed is 10 to 40 μm, preferably 20 to 30 μm. The height H2 of the ink channel 8 is about 10 to 20 μm. In the present embodiment, a wall surface forming the first ejection port portion 12 is an inclined taper, and the taper angle is about 0 to 15°.

Now, an ink ejecting operation of the print head 1 will be described.

When electricity is conducted through the electrothermal converting element 9, electric energy from the electrothermal converting element 9 is converted into heat, and the electrothermal converting element 9 generates heat. Thus, the ink in the bubbling chamber 6 positioned over the electrothermal converting element 9 boils instantaneously to generate a bubble. The ink in the bubbling chamber 6 is pushed back by a rapid bubble pressure resulting from a change of the ink into a vapor phase. The ink over the electrothermal converting element 9 thus moves. Then, the ink in the bubbling chamber 6 is pushed toward the ejection port portion 7 by bubbles. The ink is then ejected through the atmosphere side of the ejection port (the opening portion at the tip of the nozzle 5) in the ejection port portion 7. The ink ejected from the ejection port impacts the predetermined position on the print medium to form an ink dot.

In conjunction with defoaming in the bubbling chamber 6, the ink is supplied to the common liquid chamber 4 through the ink supply port 10. The ink supplied to the interior of the common liquid chamber 4 passes between the nozzle filters 11 and through the ink channel 8 and is then refilled into the bubbling chamber 6.

The ejection port portion 7, forming a channel for the ink flowing from the bubbling chamber 6 toward the ejection port, is narrowed step by step by the first ejection port portion 12 and the second ejection port portion 13. Thus, although the first ejection port portion 12 is narrow in association with the narrowest part of the ejection port, the second ejection port portion 13 may be sufficiently wider than the first ejection port portion 12. Consequently, compared to an ejection port portion formed only of the first ejection port portion 12, having a narrow channel for the ink flowing from the bubbling chamber 6 toward the ejection port, the ejection port portion 7 offers a flow resistance reduced by the wider second ejection port portion 13, to the ink passing through the ejection port portion 7. Furthermore, the orifice plate 3 can be formed to be thin only in an area in which the first ejection port portion 12 is formed and to be thick in an area in which the second ejection port portion 13 is formed. This inhibits a decrease in the strength of the print head, ensuring the reliability and durability of the print head 1.

A possible pressure loss during the passage of the ink through the ejection port portion 7 decreases with a decrease in the flow resistance to the ink in the ejection port portion 7. This prevents a decrease in the speed of the ink ejected through the ejection port portion 7 and in ink refill speed. Thus, a high ink ejection frequency can be maintained. If the nozzle offers a small ink ejection amount, the ejection port has a small opening area and the ink channel also has a small area, increasing the flow resistance to the ink. This may reduce the ink refill speed. However, the reduced flow resistance to the ink as in the case of the present embodiment allows a small amount of ink to be ejected without significantly reducing the ink refill speed in spite of a reduction in the opening area of the ejection port. Furthermore, if a nozzle with a low ink flow resistance is constructed, the area in which the first ejection port portion 12 is formed alone can be thinned without the need to thin the whole orifice plate 3 as described above. This ensures the strength of the print head 1 and improves the reliability thereof. As a result, the print head 1 according to the present embodiment allows high-quality images formed of fine ink dots to be quickly printed, with the reliability of the print head ensured.

In the present embodiment, the areas A and B have the different volumes VA and VB. That is, the volumes of the areas A and B, positioned across the partitioning plane S1, are unbalanced. Thus, when the ink is refilled into the bubbling chamber 6 after ink ejection, the ink flows from the area A with the larger volume to the area B with the smaller volume. This ink flow moves to a defoaming position where the bubbles are defoamed after ink ejection. The defoaming position is displaced from the position over the electrothermal converting element 9. That is, the ink flow moves the defoaming position, which is thus variable.

Therefore, the defoaming position is far from the electrothermal converting element 9. During the defoaming, a reduced impact is exerted on the electrothermal converting element 9. The durability of the electrothermal converting element 9 can thus be improved. Furthermore, the defoaming position is variable, allowing the possible impact during the defoaming to be dispersed. The durability of the electrothermal converting element 9 can further be improved.

Furthermore, in the present embodiment, in the supply direction D1, the center of the electrothermal converting element 9 is displaced from the center of the bubbling chamber 6. That is, as shown in FIGS. 4 and 5, the center of the former is positioned above the center of the latter in FIG. 4 (on the right side of the center of the latter in FIG. 5) and farther from the common liquid chamber 4 and the ink supply port 10 than the center of the latter. In this manner, the center of the electrothermal converting element 9 is displaced from the center of the bubbling chamber 6. Thus, the ink flows in the bubbling chamber 6 as bubbles generated over the electrothermal converting element 9 grow. Consequently, the ink flow in the bubbling chamber 6 can further be increased to further shift the defoaming position. Furthermore, the defoaming position can be shifted farther from the position immediately above the electrothermal converting element 9. This enables minimization of the possible impact exerted on the surface of the electrothermal converting element 9 by a possible instantaneous variation in pressure (cavitation) during the defoaming. As a result, the durability of the electrothermal converting element 9, thus the print head 1, can be improved.

The ink remaining between the bubbles over the electrothermal converting element 9 and the ejection port portion 7 after ink ejection starts to return to the electrothermal converting element 9 during refilling after the ink ejection. The speed vector of the ink is inclined instead of extending straight from the ejection port (the opening portion at the tip of the nozzle 5) to the electrothermal converting element 9 (from top to bottom of FIGS. 5 and 6). Thus, the defoaming position is displaced and becomes more variable. The defoaming position is thus variable, allowing the possible impact resulting from the cavitation during the defoaming to be dispersed instead of concentrating at one position. This further reduces the possible impact on the electrothermal converting element 9. The durability of the electrothermal converting element 9 is further improved.

As the ink flows, so as to improve the durability of the electrothermal converting element 9, the ink in the bubbling chamber 6 swirls during ink refilling. Thus, as shown in FIG. 7B, a trailing portion DB of a main droplet (ink droplet) DA ejected through the ejection port is subjected to the force of the ink flow in the direction of arrow F1. The ink flow in the direction of arrow F1 is directed in the bubbling chamber 6 from a wall surface of the bubbling chamber 6 (a side surface of the bubbling chamber 6 located in the left of FIG. 7B) located farther from the center of the electrothermal converting element 9 to the center of the bubbling chamber 6 (from the left to right of FIG. 7B).

Figure 7A:
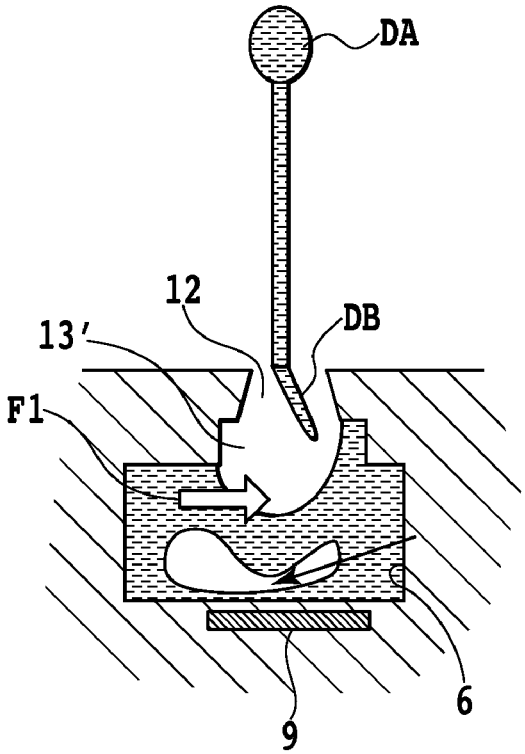
FIG. 7A is a sectional view of a conventional liquid ejecting head during droplet ejection.
Figure 7B:
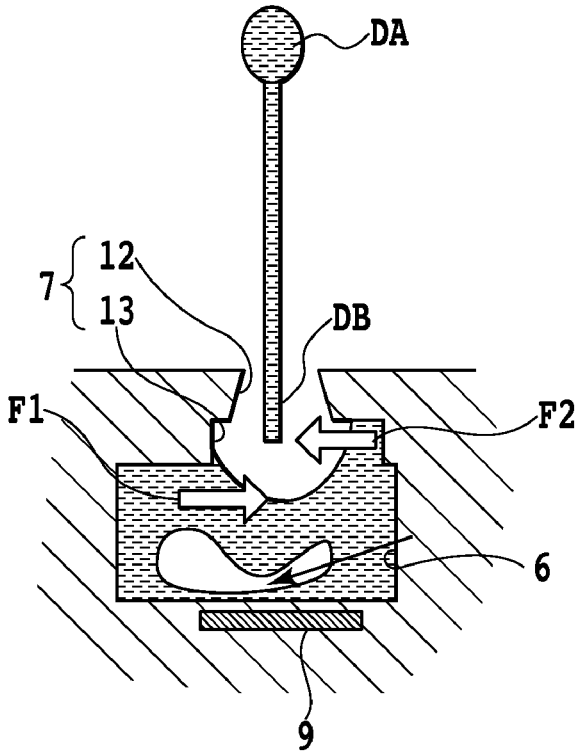
FIG. 7B is a sectional view of the liquid ejecting head according to the first embodiment of the present invention during droplet ejection.

If the volumes VA' and VB' of the areas A' and B', positioned across the partitioning plane S1, are set to be equal as in the case of the second ejection port portion 13' in FIG. 7A, then as shown in FIG. 7A, the trailing portion DB may be bent under the force of the ink flow in the direction of arrow F1. When the bent trailing portion DB is torn away and ejected as a satellite (sub-droplet), the satellite does not fly straight and may fail to impact the print medium at a predetermined position. That is, the impacting accuracy of the satellite may deteriorate.

However, as shown in FIGS. 6 and 7B, the second ejection port portion 13 according to the present embodiment is formed such that the volume VA' of the area A' is smaller than the volume VB' of the area B'. That is, the volumes VA' and VB' of the areas A' and B' are set to be unbalanced (VA'<VB') so as to cancel the unbalance (VA>VB) between the volumes VA and VB of the areas A and B, positioned across the partitioning plane S1.

The ink to which heat energy is applied by the electrothermal converting element 9 moves in the ejection direction D3 from the bubbling chamber 6 and is then ejected through the ejection port. At this time, as described above, the unbalanced ink fluidity results in the ink flow in the direction of arrow F1 in the bubbling chamber 6. The unbalanced ink fluidity also results in an ink flow in the direction of arrow F2 in the second ejection port portion 13 as shown in FIG. 7B. The direction of arrow F2 is opposite to the direction of arrow F1. Thus, the ink flow in the direction F2 acts to cancel the force of the ink flow in the direction F1 acting on the ink droplet. As a result, the forces acting on the ink droplet are balanced.

Thus, in the second ejection port portion 13, the ink flows in the direction of arrow F2 as a result of the asymmetry (VA'<VB') between the volumes VA' and VB' of the areas A' and B', that is, the unbalance of the ink fluidity between the areas A' and B'. On the other hand, as described above, in the bubbling chamber 6, the ink flows in the direction of arrow F1 as a result of the asymmetry (VA>VB) between the volumes VA and VB of the areas A and B, that is, the unbalance of the ink fluidity between the areas A and B. The bubbling chamber 6 and the second ejection port portion 13 are shaped such that the directions of arrows F1 and F2 are opposite to each other. In the present example, the force in the direction of arrow F1 resulting from the displacement of the center of the bubbling chamber 6 cancels the force in the direction of arrow F2 resulting from the displacement of the center of the second ejection port portion 13, and vice versa.

As shown in FIG. 7B, the trailing portion DB is subjected to the force in the direction of arrow F2, which is opposite to the direction of arrow F1, and this force is cancelled. Thus, the trailing portion DB is inhibited from being bent. As a result, the ejected satellite flies straight in the ejection direction D3, improving the impacting accuracy of the ink droplet.

Furthermore, the trailing portion DB is subjected to a reduced force and is thus unlikely to be torn away. Thus, the generation of the satellite is inhibited. Consequently, the satellite, which may form mist floating between the print head 1 and the print medium, is inhibited from being generated. This allows minimization of effects of adhesion of the mist to the print medium or the printing apparatus.

Thus, the print head 1 according to the present embodiment enables inhibition of bending of the trailing portion DB while reducing the possible impact force exerted on the electrothermal converting element 9 by the cavitation. Consequently, the ink jet printing apparatus 101 is provided which can maintain the high impacting accuracy of the ink droplet to print high-quality images.

Second Embodiment

A print head according to a second embodiment of the present invention will be described with reference to FIGS. 8 to 11. Components of the second embodiment which are similar to those of the first embodiment are denoted by the same reference numerals and will not be described below.

Figure 8:
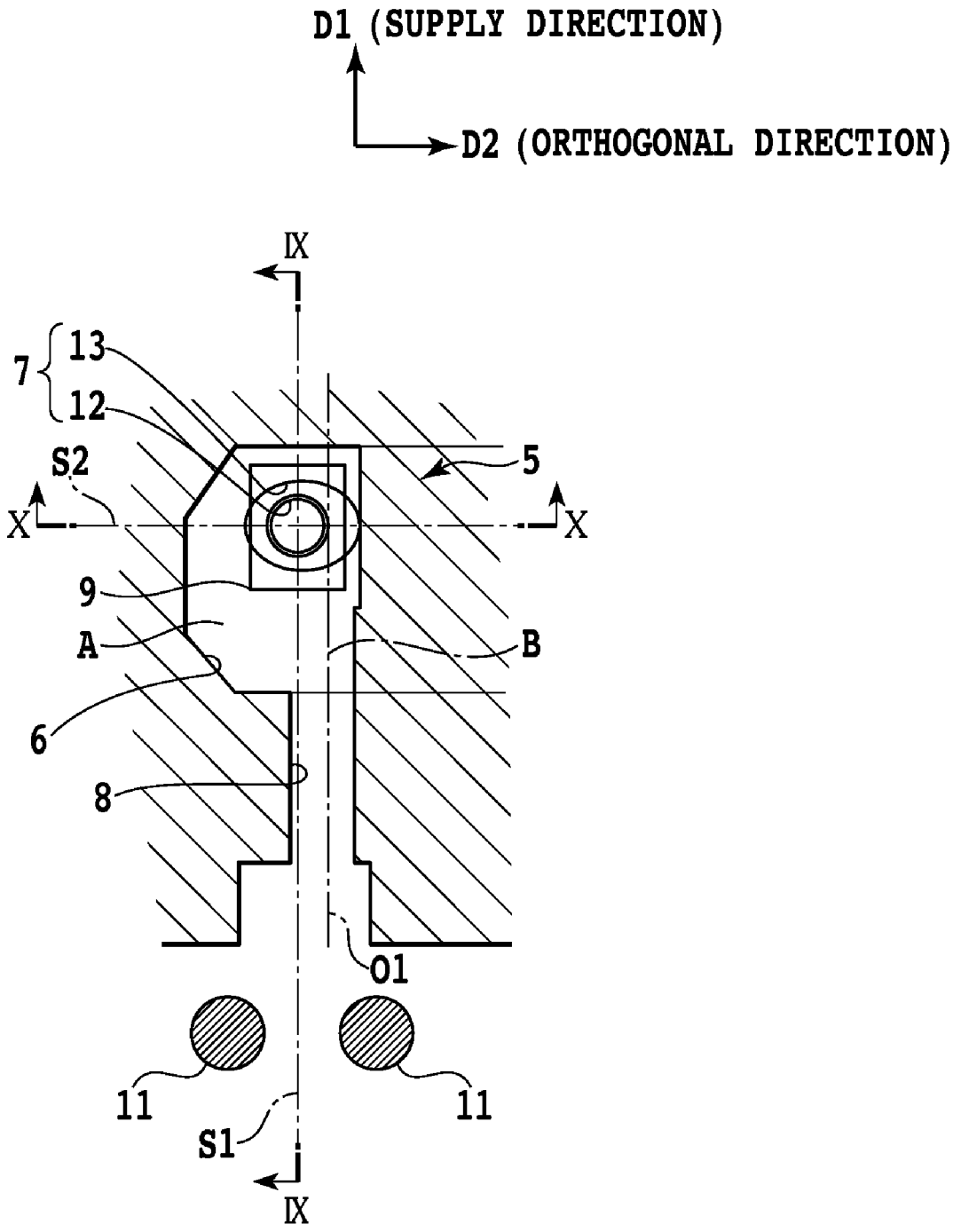
FIG. 8 is an enlarged sectional view of an essential part of a liquid ejecting head according to a second embodiment of the present invention.
Figure 9:
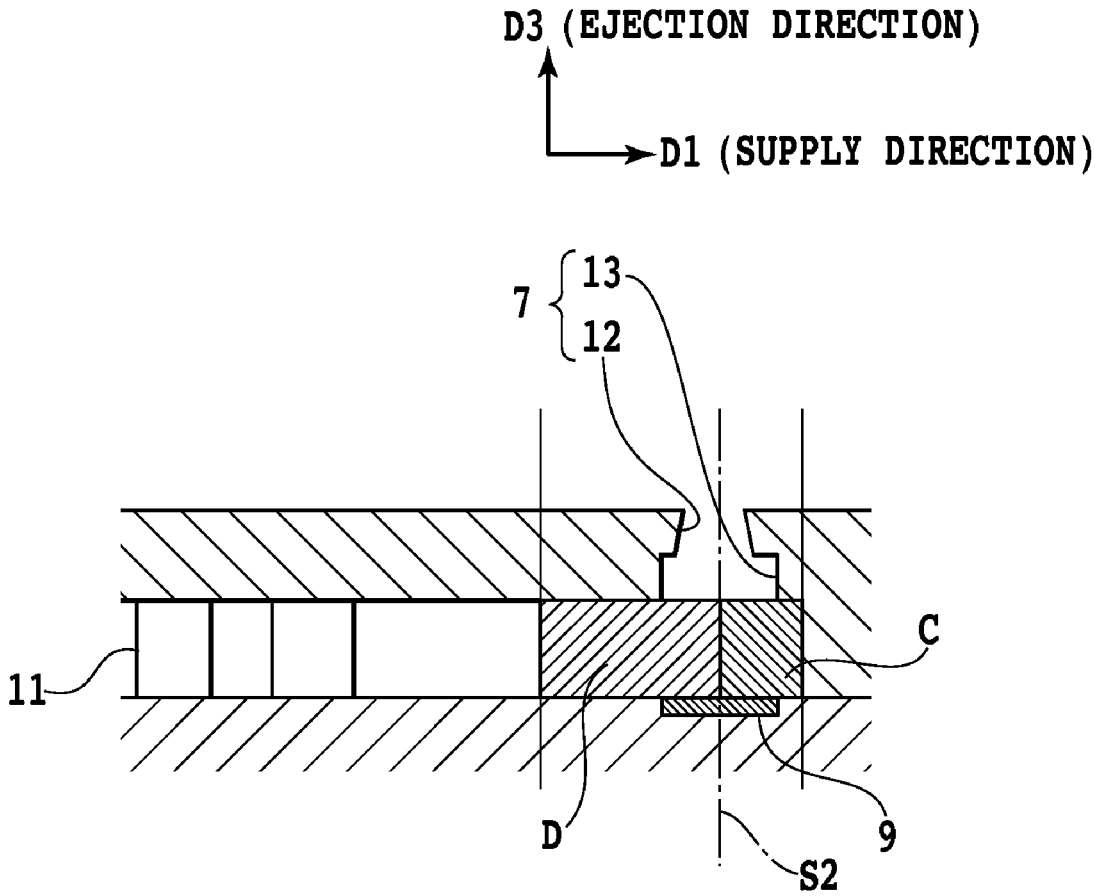
FIG. 9 is a sectional view of the liquid ejecting head in FIG. 8 taken along line IX-IX in FIG. 8.
Figure 10:
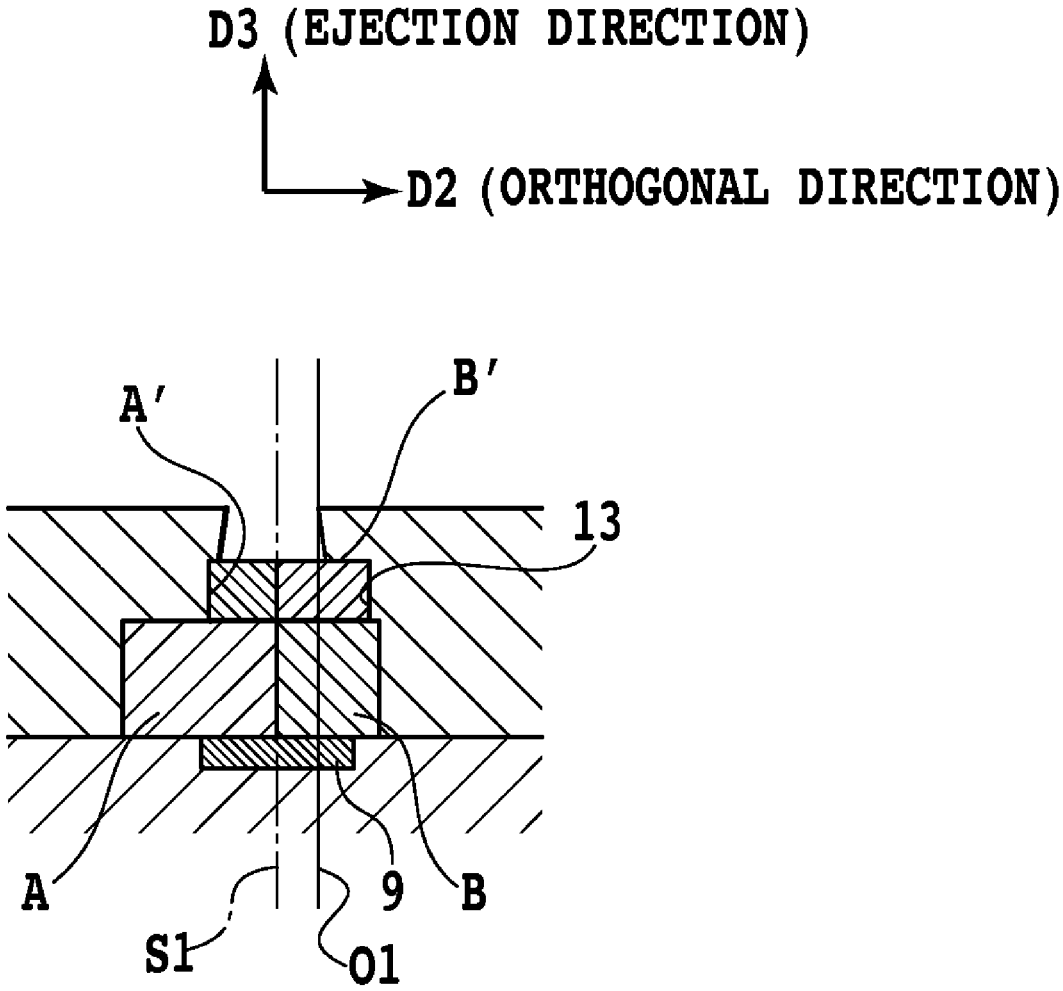
FIG. 10 is a sectional view of the liquid ejecting head in FIG. 8 taken along line X-X in FIG. 8.

FIG. 8 is a sectional view of one of the nozzles 5 in the print head according to the second embodiment as viewed in the ejection direction D3. FIG. 9 is a sectional view of the nozzle 5 taken along line IX-IX in FIG. 8. FIG. 10 is a sectional view of the nozzle 5 taken along line X-X in FIG. 8.

In the print head according to the present embodiment, as is the case with the print head 1 according to the first embodiment, the volume VA of the area A is set to be larger than the volume VB of the area B, and the volume VA' of the area A' is set to be smaller than the volume VB' of the area B'. In addition, in the present embodiment, a virtual plane passing through the center O1 of the ink channel 8 in the orthogonal direction D2 is displaced from the center of the electrothermal converting element 9 in the orthogonal direction D2 as shown in FIG. 8. Here, the virtual plane passing through the center O1 passes through the center O1 of the ink channel 8 in the orthogonal direction D2 so as to divide the volume of the ink channel 8 into two equal portions, and is parallel to both the supply direction D1 and the ejection direction D3.

Figure 11:
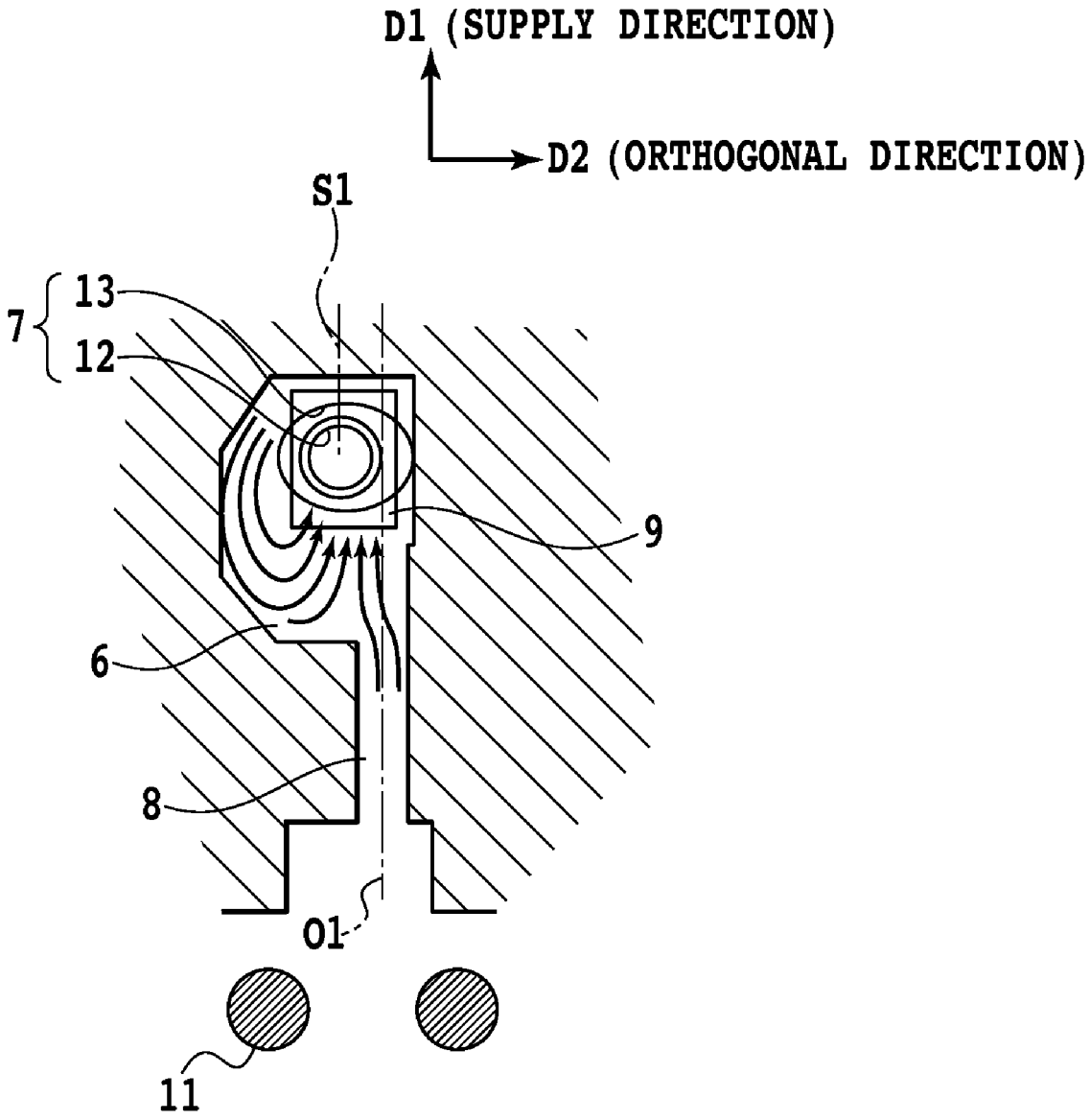
FIG. 11 is a diagram illustrating the flow of ink inside a nozzle in the liquid ejecting head in FIG. 8.

In this manner, the plane passing through the center O1 of the ink channel 8 is displaced from the center of the electrothermal converting element 9. Thus, after ejection of the ink in the bubbling chamber 6, when ink is refilled into the bubbling chamber 6, the ink flows into the bubbling chamber 6 so as to be biased toward the right of FIG. 8. Consequently, the ink being refilled into the bubbling chamber 6 whirls significantly in the chamber 6. FIG. 11 shows the ink flows in the nozzle 5 during the refilling.

The ink thus whirls significantly in the bubbling chamber 6 to displace the defoaming position far from the position over the electrothermal converting element 9. This enables a further reduction in the possible impact exerted on the surface of the electrothermal converting element 9 by the cavitation during the defoaming. Furthermore, by the significant whirling of the ink, the ink flow makes the defoaming position more variable. Thus, the defoaming position is shifted, preventing the possible impact caused by the cavitation during the defoaming from being concentrated at one position. Consequently, the possible impact exerted on the electrothermal converting element 9 can further be reduced. As a result, the durability of the electrothermal converting element 9 can further be improved.

Third Embodiment

A third embodiment of the present invention will be described with reference to FIG. 12. Components of the third embodiment which are similar to those of the first embodiment are denoted by the same reference numerals and will not be described below.

Figure 12:
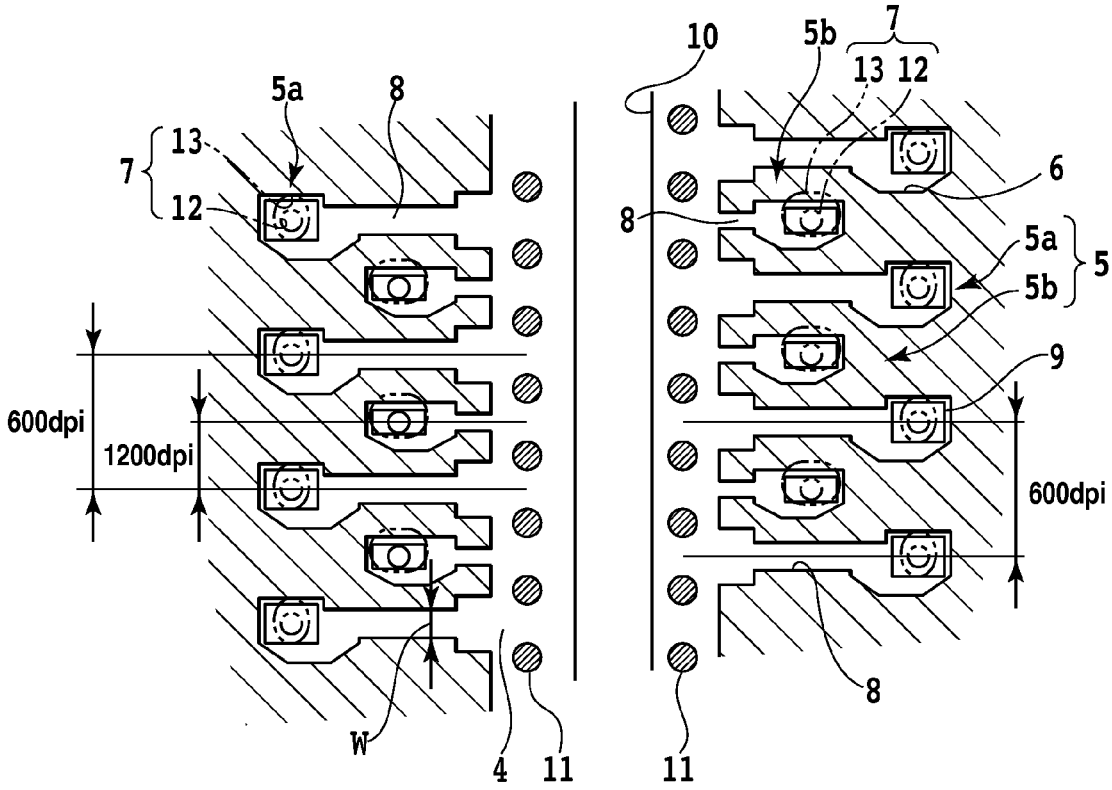
FIG. 12 is an enlarged sectional view of an essential part of a liquid ejecting head according to a third embodiment of the present invention.

FIG. 12 is a sectional view of an essential part of nozzle arrays in a print head according to the third embodiment as viewed in the ejection direction D3. The print head according to the present embodiment includes long nozzles 5*a* each having a long ink channel 8 formed therein and short nozzles 5*b* each having a short ink channel 8 formed therein; the long and short nozzles 5*a* and 5*b* are alternately arranged. The interval between the long nozzles 5*a* is set equal to a pitch corresponding to 600 dpi. The interval between the short nozzles 5*b* is also set equal to a pitch corresponding to 600 dpi. The interval between the long nozzle 5*a* and short nozzle 5*b* which are adjacent to each other is set equal to a pitch corresponding to 1,200 dpi. The nozzles 5 (5*a* and 5*b*) are formed in the same element board 2 and orifice plate 3 so that the ink is supplied to the nozzles 5 (5*a*, 5*b*) through the ink supply port 10, shared by the nozzles 5 (5*a* and 5*b*). The long nozzle 5*a* and the short nozzle 5*b* are formed so as to enable different amounts of ink to be ejected through the nozzles 5*a* and 5*b*.

In the present embodiment, the amount of ink ejected through the nozzle 5 (5*a*, 5*b*) is set to about 0.5 to 3 pl. The diameter of the opening portion (the ejection port; the opening portion at the tip of the nozzle 5 (5*a*, 5*b*)) of the first ejection port portion 12 which communicates with the atmosphere is about 5 to 12 μm. The ink ejection frequency can be set to at least 15 kHz. The diameter of the second ejection port portion 13 in the nozzle 5 (5*a*, 5*b*) is about 15 to 25 μm. The width W of the ink channel 8 is about 5 to 15 μm. The height H2 (see FIG. 5) of the ink channel 8 is 10 to 20 μm. As is the case with the above-described embodiments, the wall surface which forms the first ejection port portion 12 is taperingly inclined, and the taper angle is 0 to 15°. Furthermore, as is the case with the above-described embodiments, the volumes VA and VB are preferably in the relationship VA/VB>1.3. The volumes VB' and VA' preferably have a relationship of VB'/VA'>1.1.

The form of the nozzle 5 in the print head according to the present embodiment is such that while bubble generated in the ink is being grown and contracted by heat energy applied by the electrothermal converting element 9, the bubble does not communicate with the atmosphere. In the print head in this form, nozzles with a larger ink ejection amount preferably have a higher ratio of the volume VB' to the volume VA' (VB'/VA'). That is, the relationship between the volume VA' of one side of the second ejection port portion 13, that is, the area A', and the volume VB' of the other side of the second ejection port portion 13, that is, the area B', is preferably such that the ratio of the volume VA' to the volume VB' is set lower for nozzles with a larger ink ejection amount.

In such a print head, that is, the print head in the form in which during the ejection of ink droplet, the bubble does not communicate with the atmosphere, the scale of the ink flow in the direction F1 resulting from the displacement of the center of the electrothermal converting element 9 from the center of the bubbling chamber 6 increases consistently with the amount of ink ejected through the nozzle. Thus, the possible force exerted on the trailing portion DB of the ink droplet in the direction F1 increases consistently with the amount of ink ejected through the nozzle and the magnitude of the displacement of the center of the electrothermal converting element 9. For nozzles that eject a large amount of ink, the displacement of the center of the electrothermal converting element 9 subjects the trailing portion DB of the ink droplet to a strong force in the direction F1. However, even in such a case, setting the ratio of the volume VB' to the volume VA' to a larger value allows generation of a force in the direction F2 which cancels the force in the direction F1.

Therefore, even for nozzles with a large ink ejection amount, setting the ratio of the volume VB' to the volume VA' to a larger value allows generation of a strong force (the force in the direction F2) that cancels the strong force exerted on the trailing portion DB of the ink droplet (the force in the direction F1). As a result, the forces acting on the ink droplet are balanced, maintaining the linearity of the direction in which the trailing portion DB is ejected. This enables improving the accuracy with which the ink droplet impacts the print medium.

On the other hand, for the volumes VC and VD of areas C and D positioned across the partitioning plane S2, the ratio of the volume VD to the volume VC is preferably set higher for nozzles with a larger ink droplet ejection amount. For example, for nozzles with a larger ink drop ejection amount, the center of the electrothermal converting element 9 is displaced more significantly from the center of the bubbling chamber 6 in the supply direction D1. That is, the value of the volume VD to the volume VC (VD/VC) is increased consistently with the amount of ink droplets ejected through the nozzle. An increase in the amount of ink droplets ejected through the nozzle increases the magnitude of the possible impact exerted on the electrothermal converting element 9 during the defoaming. The durability of the electrothermal converting element 9 may thus be degraded. However, by increasing the value of the volume VD to the volume VC consistent with the amount of ink droplets ejected through the nozzle, the defoaming position can be shifted far from the position over the electrothermal converting element 9. Furthermore, the defoaming position can be shifted to improve the durability of the electrothermal converting element 9.

Other Embodiments

Figure 13:
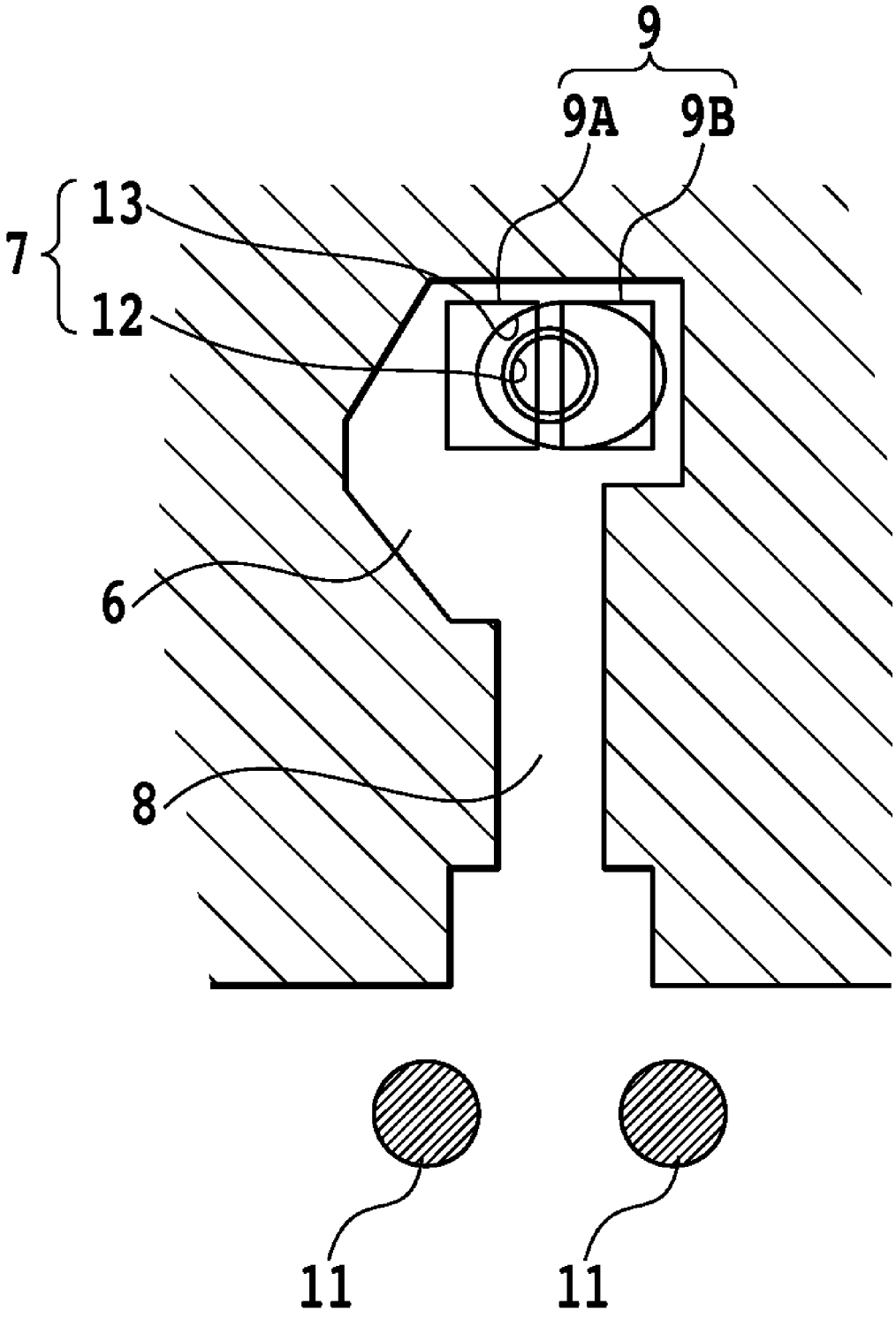
FIG. 13 is an enlarged sectional view of an essential part of a liquid ejecting head in which an electrothermal converting element is divisively placed.

In the sectional views in FIGS. 3, 4, 8, and 12, in which the nozzle 5 is viewed in the ejection direction D3, the sectional shape of the first and second ejection port portions 12 and 13 is not limited to the circle but may be an oval or a polygon. Furthermore, the electrothermal converting element 9 may be divided into a plurality of electrothermal converting elements (in the present example, two elements 9A and 9B) as shown in FIG. 13. In this case, the center of the electrothermal converting element 9 corresponds to the center of the plurality of electrothermal converting elements considered to be one element.

In the above-described embodiments, the ejection port portion 7 has the two stage structure including the first ejection port portion 12 and the second ejection port portion 13. However, the ejection port portion 7 is not limited to the two stage structure but may be configured to have at least three stages. If the ejection port portion 7 has at least three stages, the parts of the ejection port 7 other than that communicating directly with the atmosphere (the opening portion of the ejection port portion 12 in the above-described embodiments) are displaced from the center of the electrothermal converting element 9. This enables cancellation of the force acting on the ink as described above. In this case, not all the parts of the ejection port 7 other than that communicating directly with the atmosphere need to be displaced from the center of the electrothermal converting element 9. However, some of the parts of the ejection port 7 may be displaced from the center of the electrothermal converting element 9 to cancel the force acting on the ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-224022, filed Aug. 30, 2007, which is hereby incorporated by reference herein in its entirety.

What is claimed is:

1. A liquid ejecting head comprising a nozzle having an energy acting chamber provided with a heating element generating heat energy utilized to eject a liquid, and a liquid supply port communicating with the nozzle, wherein an ejection port portion communicating with the energy acting chamber is formed to eject the liquid to which heat energy is applied by the heating element, the ejection port portion has a first ejection port portion communicating with atmosphere and a second ejection port portion formed between the energy acting chamber and the first ejection port portion, the second ejection port portion has a larger sectional area than the first ejection port portion in a direction orthogonal to an ejection direction in which the liquid is ejected, when each of the energy acting chamber and the second ejection port portion is partitioned by a first virtual plane into an area positioned on a first side of the first virtual plane and an area positioned on a second side of the first virtual plane, the energy acting chamber has a larger volume in the first side area than in the second side area, and the second ejection port portion has a smaller volume in the first side area than in the second side area, and the first virtual plane is parallel to both a supply direction of a liquid flowing from the liquid supply port to the energy acting chamber and the ejection direction, and passes through a center of the heating element to divide each of the energy acting chamber and the second ejection port portion into two parts in an orthogonal direction orthogonal to the supply direction.

2. The liquid ejecting head according to claim 1, wherein when the energy acting chamber is partitioned by a second virtual plane into a first area located closer to the liquid supply port and a second area located farther from the liquid supply port, the volume of the first area is larger than that of the second area, and the second virtual plane is parallel to each of the orthogonal direction and the ejection direction, and passes through the center of the heating element to divide the energy acting chamber in the supply direction into two parts.

3. The liquid ejecting head according to claim 2, wherein while bubble generated when the heating element applies heat energy to the liquid is being grown and contracted, the bubble does not communicate with the atmosphere, and the energy acting chamber is formed such that a ratio of the volume of the first area to the volume of the second area is greater for the nozzles with a larger liquid ejection amount.

4. The liquid ejecting head according to claim 1, further comprising a liquid channel through which the liquid is fed from the liquid supply port into the energy acting chamber, wherein the center of the heating element is displaced, in the orthogonal direction, from a center of the liquid channel in the orthogonal direction.

5. The liquid ejecting head according to claim 1, wherein a plurality of the nozzles are arranged in the orthogonal direction, an opening of the ejection port portion of each of the nozzles is shaped like a circle, the ejection port portion has an opening diameter of 4 to 15 μm, and a distance between the heating element and an ejection port surface in which the ejection port portion is formed is 10 to 40 μm.

6. The liquid ejecting head according to claim 5, wherein the opening of the ejection port portion has a diameter of 7 to 11 μm, and the distance between the heating element and the ejection port surface is 20 to 30 μm.

7. The liquid ejecting head according to claim 1, wherein while bubble generated when the heating element applies heat energy to the liquid is being grown and contracted, the bubble does not communicate with the atmosphere, and the second ejection port portion is formed such that a ratio of the volume of the first side area to the volume of the second side area is less for the nozzles with a larger liquid ejection amount.

8. An ink jet printing apparatus that prints an image on a print medium using a liquid ejecting head comprising a nozzle having an energy acting chamber in which a heating element generating heat energy utilized to eject a liquid is located, and a liquid supply port communicating with the nozzle, wherein an ejection port portion communicating with the energy acting chamber is formed to eject the liquid to which heat energy is applied by the heating element, the ejection port portion has a first ejection port portion communicating with atmosphere and a second ejection port portion formed between the energy acting chamber and the first ejection port portion, the second ejection port portion has a larger sectional area than the first ejection port portion in a direction orthogonal to an ejection direction in which the liquid is ejected, when each of the energy acting chamber and the second ejection port portion is partitioned by a first virtual plane into an area positioned on a first side of the first virtual plane and an area positioned on a second side of the first virtual plane, the energy acting chamber has a larger volume in the first side area than in the second side area, and the second ejection port portion has a smaller volume in the first side area than in the second side area, and the first virtual plane is parallel to both a supply direction of a liquid flowing from the liquid supply port to the energy acting chamber and the ejection direction, and passes through a center of the heating element to divide each of the energy acting chamber and the second ejection port portion into two parts in an orthogonal direction orthogonal to the supply direction.

* * * * *